US009348278B2

(12) United States Patent
Matsuno

(10) Patent No.: US 9,348,278 B2
(45) Date of Patent: May 24, 2016

(54) FIXING DEVICE HAVING PRESSING MEMBERS FOR PRESSING ENDLESS BELT

(71) Applicant: Brother Kogyo Kabushiki Kaisha, Nagoya-shi, Aichi-ken (JP)

(72) Inventor: Takuji Matsuno, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/227,639

(22) Filed: Mar. 27, 2014

(65) Prior Publication Data

US 2014/0294466 A1 Oct. 2, 2014

(30) Foreign Application Priority Data

Mar. 28, 2013 (JP) ..... 2013-069015

(51) Int. Cl.
*G03G 15/20* (2006.01)

(52) U.S. Cl.
CPC ..... *G03G 15/2053* (2013.01); *G03G 15/2017* (2013.01)

(58) Field of Classification Search
CPC ..... G03G 15/2085; G03G 15/2053; G03G 15/2017
USPC ..... 399/329
See application file for complete search history.

(56) References Cited

U.S. PATENT DOCUMENTS

2005/0220509 A1* 10/2005 Kubochi et al. ..... 399/329
2011/0299900 A1* 12/2011 Yonekawa et al. ..... 399/329

FOREIGN PATENT DOCUMENTS

JP 2000-194209 A 7/2000
JP 2006-251068 A 9/2006
JP 2007-206615 A 8/2007

* cited by examiner

*Primary Examiner* — Quana M Grainger
(74) *Attorney, Agent, or Firm* — Banner & Witcoff, Ltd.

(57) ABSTRACT

A fixing device may include an endless belt configured to circularly move about an axis extending in an axial direction, a first pressing member and a second pressing member. The endless belt may have an inner peripheral surface and an outer peripheral surface, the outer peripheral surface having a first outer end portion and a second outer end portion in the axial direction, and the inner peripheral surface having a first inner end portion and a second inner end portion in the axial direction. The first pressing member may have a first contact portion in contact with the first outer end portion for pressing the first outer end portion toward the inner peripheral surface. The second pressing member may have a second contact portion in contact with the second outer end portion for pressing the second outer end portion toward the inner peripheral surface.

19 Claims, 6 Drawing Sheets

FIXING DEVICE HAVING PRESSING MEMBERS FOR PRESSING ENDLESS BELT

CROSS REFERENCE TO RELATED APPLICATION

This application claims priority from Japanese Patent Application No. 2013-069015 filed Mar. 28, 2013. The entire content of the priority application is incorporated herein by reference.

TECHNICAL FIELD

The present invention relates to a fixing device provided with an endless belt.

BACKGROUND

There is conventionally known a fixing device that includes an endless belt and a guide member for guiding an inner peripheral surface of the endless belt (refer to Japanese Patent Application Publication No. 2000-194209, for example). In this fixing device, the guide member serves to prevent inward deformation of the inner peripheral surface of the endless belt.

SUMMARY

However, in the above-described configuration, since no guide member is provided for guiding an outer peripheral surface of the endless belt, movement of the endless belt may become unstable if the endless belt warps (or deforms) radially outward.

In view of the foregoing, it is an object of the present invention to provide a fixing device which stabilizes a movement of an endless belt.

In order to attain the above and other objects, the present invention provides a fixing device that may include an endless belt, a first pressing member and a second pressing member. The endless belt is configured to circularly move about an axis extending in an axial direction. The endless belt may have an inner peripheral surface and an outer peripheral surface. The outer peripheral surface may have a first outer end portion and a second outer end portion in the axial direction and the inner peripheral surface may have a first inner end portion and a second inner end portion in the axial direction. The first pressing member may have a first contact portion configured to be in contact with the first outer end portion, the first pressing member being configured to press the first outer end portion toward the inner peripheral surface. The second pressing member may have a second contact portion configured to be in contact with the second outer end portion, the second pressing member being configured to press the second outer end portion toward the inner peripheral surface.

DETAILED DESCRIPTION

First, a general structure of a color laser printer 1 as an image forming device according to an embodiment of the present invention will be described with reference to FIG. 1. The color laser printer 1 is provided with a fixing device 100 according to the embodiment of the present invention.

<General Structure of Color Laser Printer>

Throughout the specification, the terms "above", "below", "right", "left", "front", "rear" and the like will be used assuming that the laser printer 1 is disposed in an orientation shown in FIG. 1, unless specified otherwise. More specifically, a right side, a left side, a near side and a far side in FIG. 1 are to be referred to as a front side, a rear side, a left side and a right side, respectively.

Figure 1:
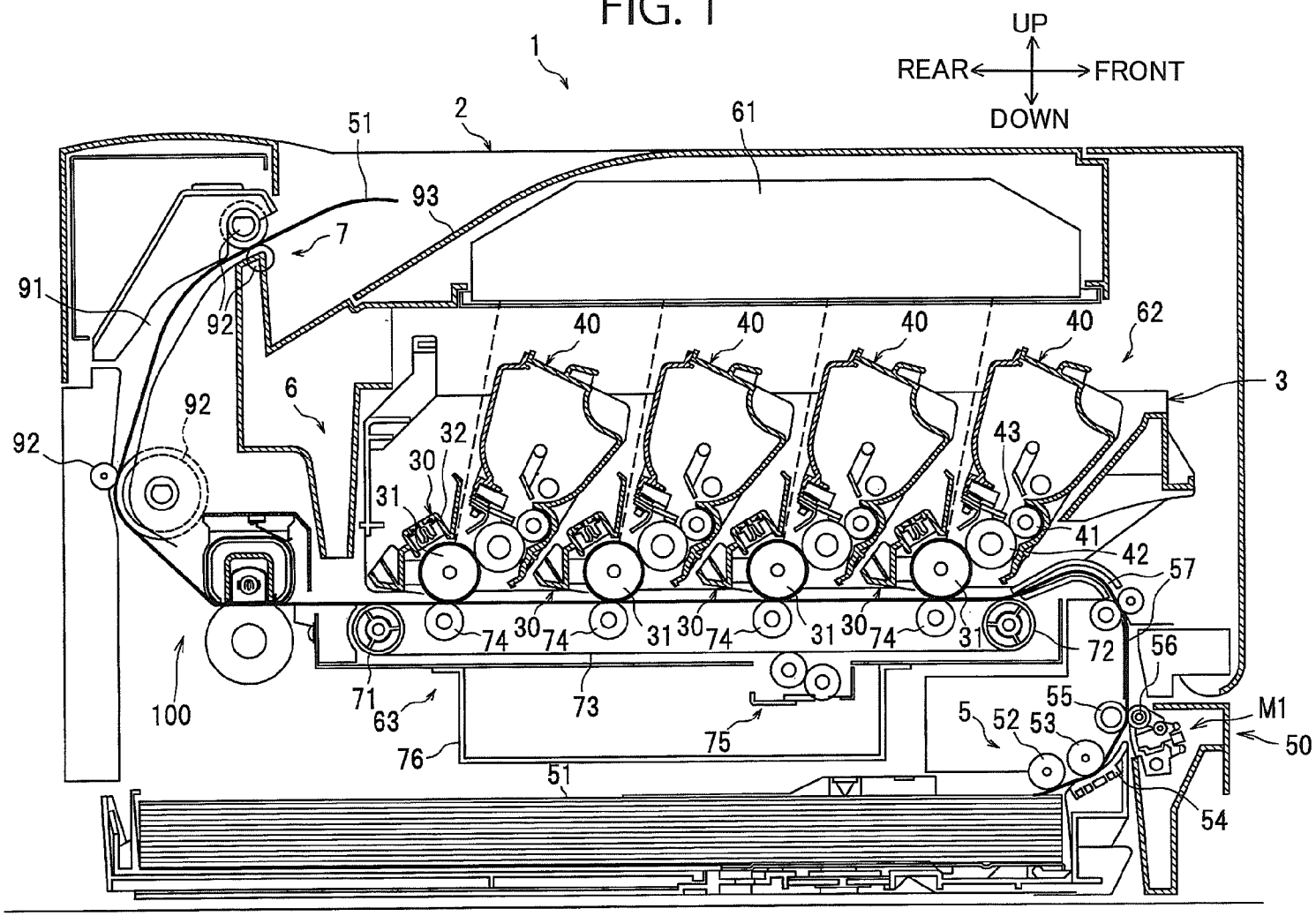
FIG. 1 is a schematic cross-sectional side view of a color laser printer provided with a fixing device according to an embodiment of the present invention.

As shown in FIG. 1, the color laser printer 1 includes a main frame 2 within which a sheet supply unit 5, an image forming unit 6 and a discharge unit 7 are disposed. The sheet supply unit 5 is configured to supply sheets of paper 51. The image forming unit 6 is configured to form images on the supplied sheets 51. The discharge unit 7 is configured to discharge the image-formed sheets 51.

The sheet supply unit 5 is disposed at a lower portion of the main frame 2. The sheet supply unit 5 includes a sheet supply tray 50 and a conveyance mechanism M1. The sheet supply tray 50 is attached to and detached from the main frame 2 by slidingly moving the sheet supply tray 50 in a front-rear direction. The conveyance mechanism M1 is configured to lift up each sheet 51 from the sheet supply tray 50 at a front side thereof and covey the sheet 51 rearward while reversing a conveyance direction of the sheet 51.

The conveyance mechanism M1 includes a pickup roller 52, a separation roller 53, and a separation pad 54. The pickup roller 52, separation roller 53 and separation pad 54 are provided at a front end portion of the sheet supply tray 50 and serve to separate the sheets 51 one by one and convey the sheet 51 upward. Paper dusts are removed from each upwardly conveyed sheet 51 while the sheet 51 passes between a paper-dust removing roller 55 and a pinch roller 56. Each sheet 51 is then directed rearward along a conveyance path 57 while making a turn to the rear, fed onto a conveying belt 73, and then conveyed to the fixing device 100.

The image forming unit 6 includes a scanner unit 61, a process unit 62, a transfer unit 63, and the fixing device 100.

The scanner unit 61 is provided at an upper portion of the main frame 2. Although not shown, the scanner unit 61 includes a laser emission part, a polygon mirror, and a plurality of lenses and reflection mirrors. In the scanner unit 61, laser beams corresponding to respective colors of cyan, magenta, yellow, and black are emitted from the laser emission part, scanned at a high speed in a left-right direction by the polygon mirror, pass through or are reflected (deflected) by the plurality of lenses and reflection mirrors, and then are irradiated onto respective photosensitive drums 31.

The process unit 62 is disposed upward of the sheet supply unit 5 and downward of the scanner unit 61. The process unit 62 includes a photosensitive unit 3 which is movable in the front-rear direction relative to the main frame 2. The photosensitive unit 3 includes four drum sub-units 30 and four developing cartridges 40 mountable on the respective drum sub-units 30.

The drum sub-units 30 are disposed at a lower portion of the photosensitive unit 3. Each drum sub-unit 30 includes one photosensitive drum 31 and a Scorotron charger 32 well-known in the art. Each developing cartridge 40 internally accommodates toner and includes a supply roller 41, a developing roller 42, and a thickness regulation blade 43 well-known in the art.

In this process unit 62, following operations are performed. In each developing cartridge 40, the toner is supplied to the developing roller 42 by the supply roller 41. At this time the toner is tribocharged to a positive polarity between the supply roller 41 and developing roller 42. As the developing roller 42 rotates, the toner supplied to the developing roller 42 is regulated by the thickness regulation blade 43 and is thereby carried as a thin layer with uniform thickness on a surface of the developing roller 42.

Meanwhile, in each drum sub-unit 30, the Scorotron charger 32 charges the photosensitive drum 31 uniformly to a positive polarity using corona discharge. This charged photosensitive drum 31 is irradiated with the laser beam from the scanner unit 61, and an electrostatic latent image corresponding to an image to be formed on the sheet 51 is formed on the photosensitive drum 31.

As the photosensitive drum 31 rotates, the toner carried on the developing roller 42 is supplied to the electrostatic latent image on the photosensitive drum 31, the electrostatic latent image being a portion having a lower potential than other portion on the uniformly positively charged surface of the photosensitive drum 31 due to exposure by the laser beam. In this way, the electrostatic latent image formed on each photosensitive drum 31 is developed into a visible image. A toner image of a corresponding color is thus carried on the surface of each photosensitive drum 31 through reversal development.

The transfer unit 63 includes a driving roller 71, a following roller 72, the conveying belt 73, four transfer rollers 74, and a cleaning part 75.

The driving roller 71 and the following roller 72 are disposed in parallel to and separated from each other in the front-rear direction. The conveying belt 73 is an endless belt, and is wound over the driving roller 71 and the following roller 72 in a taut state. The conveying belt 73 has an outer peripheral surface in contact with each of the photosensitive drums 31.

The transfer rollers 74 are disposed at an internal space of the conveying belt 73 such that the conveying belt 73 is interposed between the transfer rollers 74 and the respective photosensitive drums 31. The transfer rollers 74 are applied with a transfer bias from a high-voltage circuit board (not shown). During image formation, the sheet 51 conveyed on the conveying belt 73 is nipped between the photosensitive drums 31 and the corresponding transfer rollers 74, and the toner images on the surfaces of the photosensitive drums 31 are sequentially transferred onto the sheet 51.

The cleaning part 75 is disposed downward of the conveying belt 73. The cleaning part 75 is configured to remove toner that has adhered to the conveying belt 73, and to cause the removed toner to fall into a toner reservoir 76 disposed below the conveying belt 73.

The fixing device 100 is disposed rearward of the transfer unit 63. The fixing device 100 is configured to thermally fix the toner image that has been transferred onto the sheet 51 thereon.

In the discharge unit 7, a sheet discharge path 91 is formed. The sheet discharge path 91 extends generally upward from an exit of the fixing device 100 and then bends frontward. A plurality of conveying rollers 92 is disposed along the sheet discharge path 91 for conveying the sheet 51. A discharge tray 93 is formed on an upper surface of the main frame 2 for receiving the image-formed sheets 51. The sheets 51 conveyed by the conveying rollers 92 along the sheet discharge path 91 are discharged onto the discharge tray 93.

<Detailed Structure of the Fixing Device>

Next, a detailed structure of the fixing device 100 according to the embodiment will be described with reference to FIGS. 2 and 3.

Figure 2:
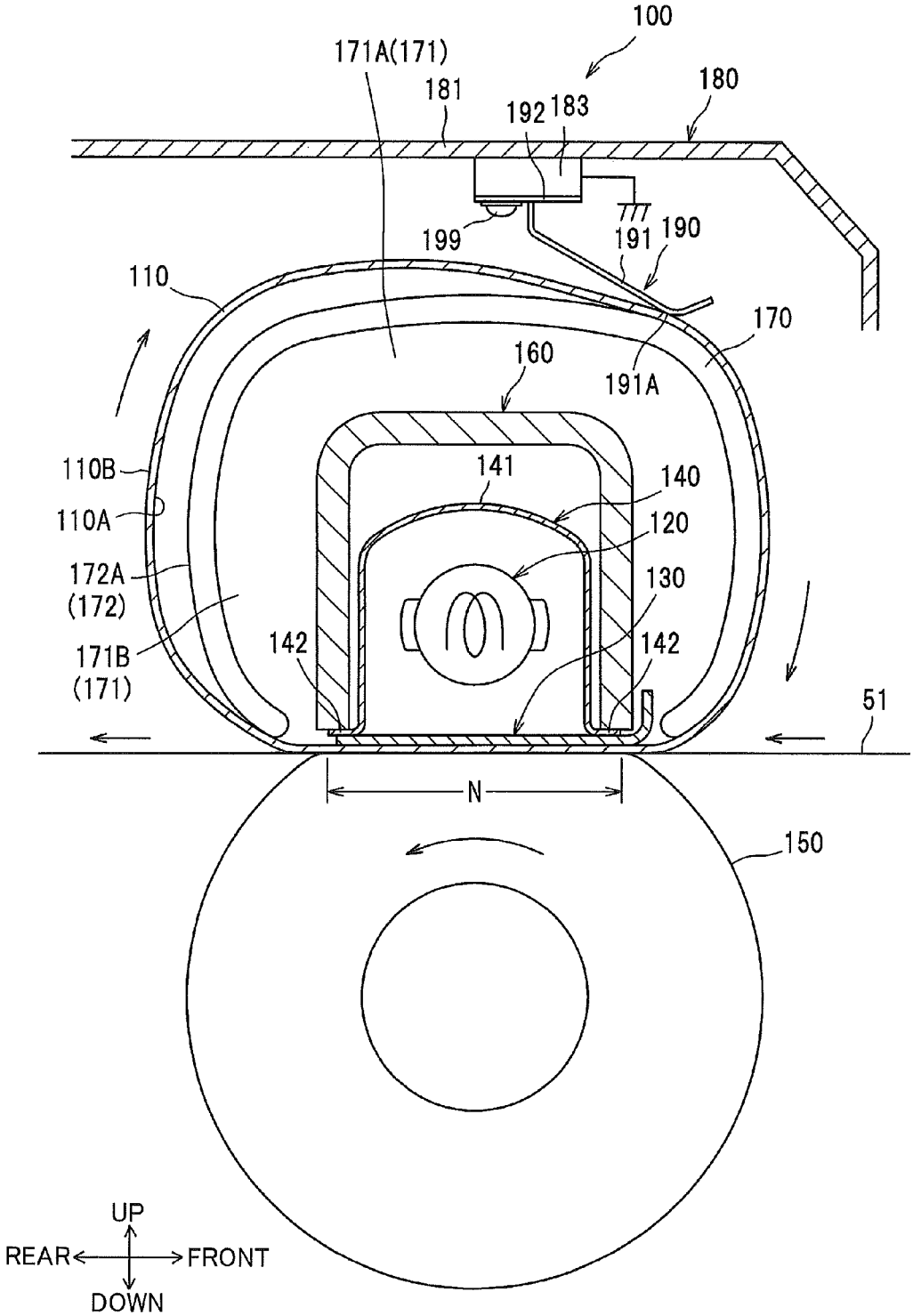
FIG. 2 is a schematic cross-sectional view of the fixing device according to the embodiment.

As shown in FIG. 2, the fixing device 100 includes an endless belt 110 as an example of an endless belt, a halogen lamp 120, a nip plate 130, a reflection plate 140, a pressure roller 150 as an example of a rotary body, a stay 160, a pair of guide members 170 as examples of first guides and second guide (only one of which is shown), a fixing frame 180 as an example of a frame, and a pair of leaf spring members 190 as examples of first and second pressing members (only one of which is shown).

The endless belt 110 is an endless belt having heat resistivity and flexibility. The endless belt 110 is configured to be in contact with the pressure roller 150 and follow rotation thereof to provide a nip region N between the endless belt 110 and the pressure roller 150. The endless belt 110 is configured to circularly move about an axis thereof extending in the left-right direction. The endless belt 110 is configured to move rearward at the nip region N. Hereinafter, a direction in which the endless belt 110 circularly moves is referred to as a circular movement direction of the endless belt 110. The endless belt 110 has an inner peripheral surface 110A configured to be in sliding contact with the nip plate 130, and an outer peripheral surface 110B configured to be in sliding contact with the pressure roller 150.

The endless belt 110 includes a metal base tube made from a metal such as a stainless steel. Incidentally, the endless belt 110 may have a rubber layer that coats the metal base tube, or may further have a nonmetallic protective layer, such as a fluorine coating layer, that coats the rubber layer.

Figure 3:
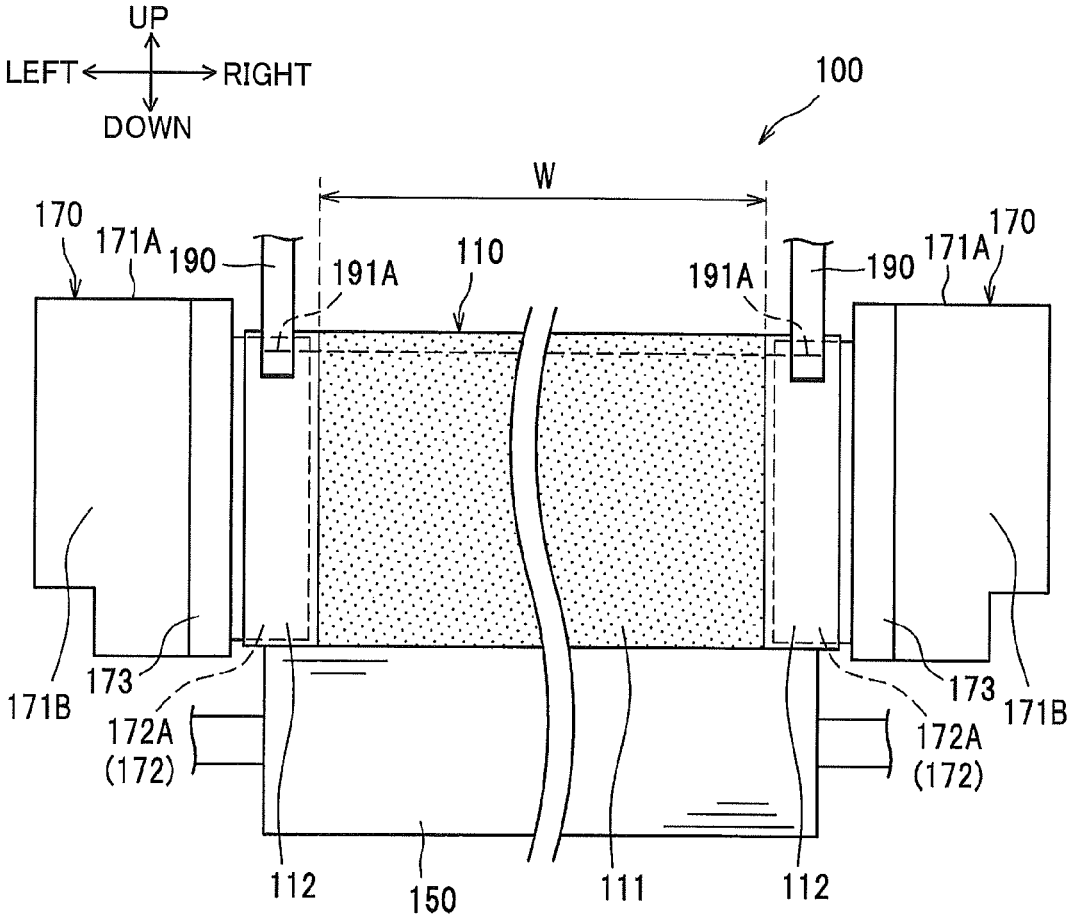
FIG. 3 is a front view of the fixing device according to the embodiment.

As shown in FIG. 3, the endless belt 110 is configured of a central portion 111 and a pair of end portions 112 with respect to the left-right direction. The central portion 111 constitutes a central portion of the endless belt 110 and the both end portions 112 constitute left and right end portions of the endless belt 110 in the left-right direction. The central portion 111 has a surface coated with a resin, while the end portions 112 are not coated with a resin but respective metallic portions thereof (metal base tube) are exposed. In the present embodiment, the central portion 111 has a length the same as a length of an image forming region W in the left-right direction. The image forming region W is a region over which sheets are configured to pass for image formation, the sheets having a width largest among those of various types of sheets that can be used in the color laser printer 1. Incidentally, the left-right length of the central portion 111 may be larger than the left-right length of the image forming region W.

Returning to FIG. 2, the halogen lamp 120 is a well-known heater configured to generate radiant heat and heat the nip plate 130 and the endless belt 110 for heating the toner on the sheet 51. The halogen lamp 120 is disposed in an internal space of the endless belt 110 and is spaced away from the inner peripheral surface 110A of the endless belt 110 and an inner surface of the nip plate 130 at a predetermined distance.

The nip plate 130 is a plate-shaped member configured to receive radiant heat from the halogen lamp 120 and is in contact with the inner peripheral surface 110A of the endless belt 110. The nip plate 130 is configured to transfer the radiant heat from the halogen lamp 120 onto the toner on the sheet 51 through the endless belt 110. The nip plate 130 is made from a material such as aluminum having a thermal conductivity higher than that of the stay 160 (described later).

The reflection plate 140 is a member adapted to reflect the radiant heat from the halogen lamp 120 (the radiant heat emitted primarily in the front-rear direction and in an upward direction) toward the nip plate 130. The reflection plate 140 is disposed in the internal space of the endless belt 110 to surround the halogen lamp 120 with a prescribed distance therefrom.

Thus the reflection plate 140 can efficiently concentrate (accumulate) the radiant heat from the halogen lamp 120 onto the nip plate 130 to promptly heat the nip plate 130 and the endless belt 110.

The reflection plate 140 has a substantial U-shape in cross-section and is formed by bending a material such as an aluminum having a high reflection ratio with regard to infrared ray and far infrared ray. More specifically, the reflection plate 140 includes a U-shaped reflecting portion 141 and flange portions 142 extending outward from each end portion of the reflecting portion 141 in the front-rear direction. Incidentally, a mirror surface finishing is available on the surface of the aluminum reflection plate 140 for specular reflection in order to enhance heat reflection ratio.

The pressure roller 150 is configured to be in contact with the outer peripheral surface 110B of the endless belt 110 to form the nip region N therebetween. The pressure roller 150 is disposed downward of the nip plate 130 to nip the endless belt 110 between the pressure roller 150 and the nip plate 130.

The stay 160 is adapted to support the nip plate 130 through the flange portions 142 of the reflection plate 140 to secure rigidity of the nip plate 130. The stay 160 is disposed to cover the reflection plate 140. The stay 160 is generally U-shaped in cross-section in conformance with an outer contour of the reflection portion 141 (the reflection plate 140). The stay 160 is formed by bending a steel plate into a U-shape, thereby having relatively high rigidity.

As shown in FIGS. 2 and 3, the guide members 170 are disposed at left and right end portions of the endless belt 110 for guiding left and right end portions of the inner peripheral surface 110A of the endless belt 110. Hereinafter, since both guide members 170 have the same construction as each other, only one of the guide members 170 will be described. Incidentally, the left and right guide members 170 may be connected to each other.

Specifically, each guide member 170 includes a holding part 171, a guide part 172, and a pair of regulating parts 173.

The holding part 171 includes a top wall 171A and a pair of side walls 171B extending downward from front and rear ends of the top wall 171A. The holding part 171 is provided to surround left or right end portion of the halogen lamp 120, the nip plate 130, the reflection plate 140, and the stay 160 to directly or indirectly support the same.

The guide part 172 is a rib protruding inward from an inner end surface of the holding part 171 in the left-right direction. The guide part 172 has a C shape whose opening faces downward (see FIG. 2). The guide part 172 has an outer surface configured to be in sliding contact with the inner peripheral surface 110A of left or right end portion of the endless belt 110 in the left-right direction. This outer surface of the guide part 172 functions as a guide surface 172A for guiding the inner peripheral surface 110A of the endless belt 110.

The regulating parts 173 protrude from the respective side walls 171B outward in a direction perpendicular to the axis of the endless belt 110. The regulating parts 173 have an arcuate shape in a side view. The regulating parts 173 are configured to abut on corresponding end face (left or right end face) of the endless belt 110 to restrict displacement of the endless belt 110 in the left-right direction.

The fixing frame 180 includes a top frame 181 and a bottom frame (not shown). As shown in FIG. 2, the top frame 181 covers the endless belt 110 and the guide members 170 from above. Although not shown, the bottom frame holds the side walls 171B (front and rear walls) of each guide member 170 in the front-rear direction to vertically movably support the guide members 170.

A pair of mounting parts 183 is provided on the top frame 181 one on each end portion of the top frame 181 in the left-right direction. The leaf spring members 190 are mounted on the mounting parts 183, respectively. Incidentally, the left and right mounting parts 183 may be connected to each other.

Specifically, the mounting parts 183 are provided on a lower surface of the top frame 181 at positions facing a general center of the endless belt 110 in the front-rear direction. The mounting parts 183 are made of a material such as a metal or an electrically conductive resin, for example, and are directly or indirectly electrically grounded. In other words, the leaf spring members 190 are electrically grounded through the mounting parts 183. Incidentally, the mounting parts 183 may be integrally formed with the top frame 181.

The leaf spring members 190 are respectively configured to press left and right end portions of the outer peripheral surface 110B of the endless belt 110 toward the inner peripheral surface 110A of the endless belt 110, i.e., diagonally rearward and downward. Hereinafter, only one of the leaf spring members 190 on the right will be described, since the leaf spring member 190 on the left has the same configuration as the right leaf spring member 190.

The leaf spring member 190 is formed by bending a metal plate. The leaf spring member 190 includes a base portion 192 and a distal end portion 191. The base portion 192 is fixed to the corresponding mounting part 183 by a screw 199. The distal end portion 191 extends downward from the base portion 192, and is then elongated diagonally frontward and downward. The distal end portion 191 of the leaf spring member 190 is thus resiliently deformable in the up-down direction. In other words, the distal end portion 191 is resiliently deformable so as to move away from the endless belt 110. Incidentally, the right and left base portions 192 may be connected to each other, or the base portions 192 may be fixed directly to the top frame 181.

In the circular movement direction of the endless belt 110, the distal end portion 191 is positioned downstream of the base portion 192, i.e., frontward relative to the base portion 192. In other words, the leaf spring member 190 is disposed to extend in a direction following the circular movement of the endless belt 110. The distal end portion 191 is bent into a curved shape in cross-section to provide a curved portion 191A. The curved portion 191A protrudes toward the right end portion of the outer peripheral surface 110B of the endless belt 110 so as to be in contact with the outer peripheral surface 110B of the endless belt 110. This curved portion 191A functions as a contact surface 191A (as examples of first and second contact portions) configured to be in contact with the outer peripheral surface 110B of the endless belt 110. In other words, the contact surface 191A has a curved shape in a side view.

The contact surface 191A is positioned frontward relative to the nip region N, i.e., upstream of the nip region N in the circular movement direction of the endless belt 110. The endless belt 110 is nipped between the contact surface 191A and the guide surface 172A of the corresponding guide member 170, as shown in FIG. 2.

Further, as shown in FIG. 3, each contact surface 191A is disposed outside of the image forming region W in the left-right direction. The contact surfaces 191A are thus in contact with the end portions 112 of the endless belt 110, i.e., with the portions at which metal (metal base tube) is exposed. In other words, the leaf spring members 190 are configured not to be in contact with the endless belt 110 within the image forming region W. Through the contact with the end portions 112 of the endless belt 110, the leaf spring members 190 are electrically connected to the endless belt 110.

The contact surfaces 191A are disposed at the same position as each other in the up-down direction and front-rear direction. In other words, the contact surfaces 191A are positioned to be aligned with each other in the left-right direction.

With the above-described structure of the fixing device according to the embodiment, following operational and technical advantages can be achieved.

The pair of leaf spring members 190 is disposed at the left and right end portions 112 of the outer peripheral surface 110B of the endless belt 110 and is configured to press the outer peripheral surface 110B toward the inner peripheral surface 110A side (or toward radially inward of the endless belt 110). This structure can suppress the endless belt 110 from deforming or deflecting toward the outer peripheral surface 110B side (or outward in the radial direction thereof, or outward in a thickness direction of the endless belt 110). As a result, the circular movement of the endless belt 110 can be stabilized.

The distal end portions 191 of the respective leaf spring members 190 are configured to deform so as to move away from the endless belt 110. The outward deformation of the endless belt 110 can therefore be restrained. Load applied to the endless belt 110 can also be reduced.

Further, the pair of leaf spring members 190 is provided to extend in a direction following the circular movement of the endless belt 110. Traveling of the endless belt 110 can be made smooth.

Further, the left and right contact surfaces 191A are positioned to be aligned with each other in the left-right direction. So, well-balanced pressure can be applied to the endless belt 110 by the pair of leaf spring members 190.

Further, the contact surfaces 191A of the distal end portions 191 have a curved shape. Thus, a contact area between each leaf spring member 190 and the endless belt 110 can be reduced. For this reason, in comparison to a configuration where contact surfaces do not have a curved shape, a contact resistance between the endless belt 110 and the leaf spring members 190 can be made low, and the circular movement of the endless belt 110 can be made smooth.

Since the endless belt 110 is nipped between the leaf spring members 190 and the guide members 170, the endless belt 110 can be supported in a stable manner. Hence, circular movement of the endless belt 110 can be made more stable, in comparison to a configuration in which a fusing belt is not interposed between a leaf spring member and a guide member.

Further, the leaf spring members 190 are not in contact with the endless belt 110 within the image forming region W. So any effect on printing can be prevented.

Further, the endless belt 110 and the leaf spring members 190 are electrically conductive with each other and the leaf spring members 190 are electrically grounded. Hence, electrical charges in the endless belt 110 can be stabilized.

Incidentally, in a configuration where a stationary guide member is provided for guiding an outer peripheral surface of a fusing belt and the guide member has a guide surface elongated in the left-right direction, the fusing belt may possibly abut on the guide surface if the fusing belt becomes vertically deflected. As a result, more load is likely to be applied to the fusing belt and the guide surface. Alternatively, if such stationary guide member has a relatively short guide surface in the left-right direction, the guide member may not reliably guide the outer peripheral surface of the fusing belt when the fusing belt is displaced in the left-right direction. In contrast, in the above-described embodiment, the leaf spring members 190 are provided to guide the outer peripheral surface of the endless belt 110. With this structure, since the distal end portions 191 of the leaf spring members 190 can deform so as to move away from the endless belt 110, smaller load is applied on the endless belt 110 even if the endless belt 110 becomes vertically deflected. Moreover, since the leaf spring members 190 press the endless belt 110 toward the outer peripheral surface 110B side (radially inward of the endless belt 110), the endless belt 110 is less likely to be displaced in the left-right direction and the endless belt 110 can be reliably guided.

Various modifications are conceivable.

In the leaf spring members 190 of the above-described embodiment, the distal end portions 191 are positioned downstream of the corresponding base portions 192 in the circular movement direction of the endless belt 110. However, the distal end portions 191 may not necessarily be positioned downstream of the corresponding base portions 192.

Figure 4:
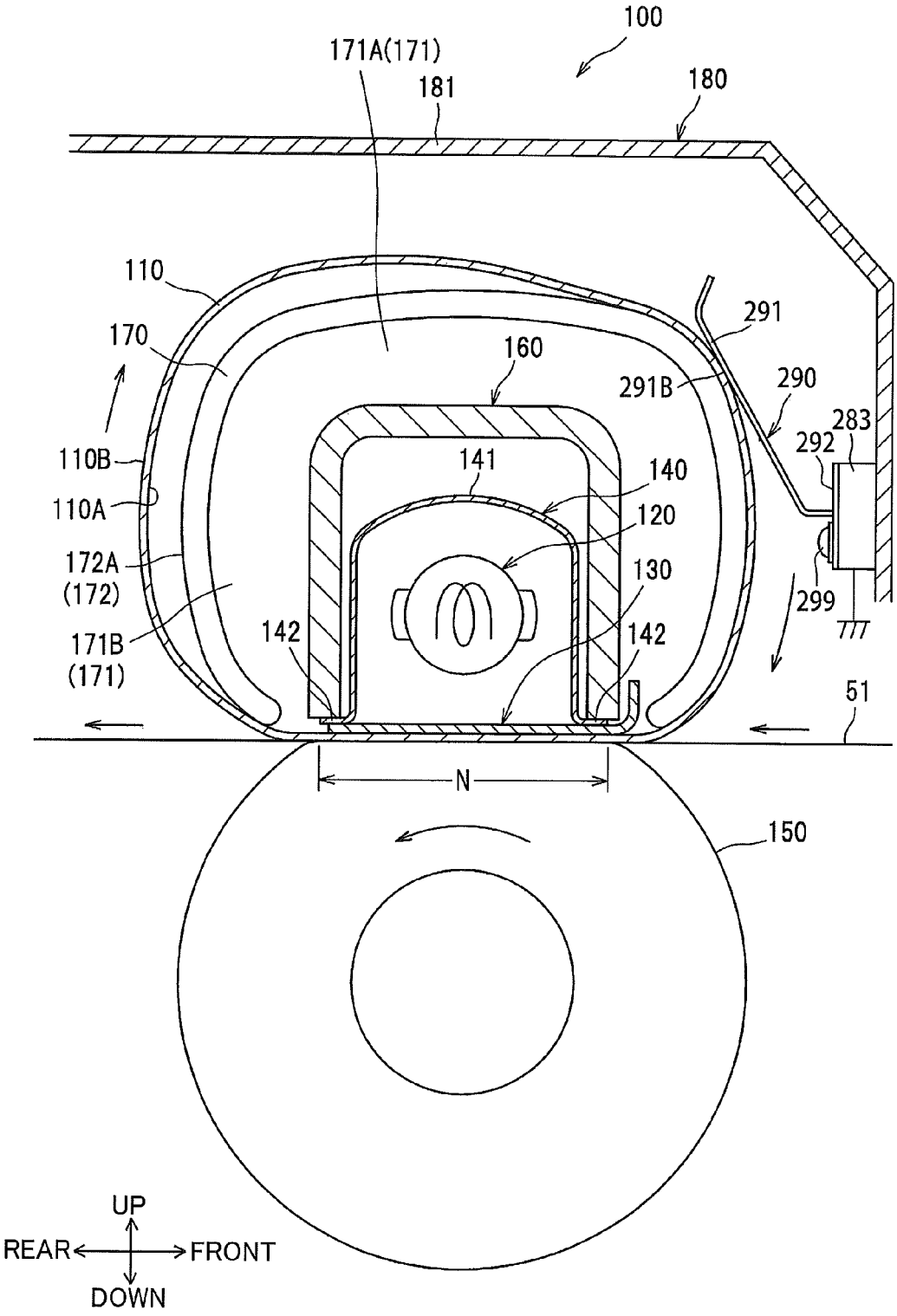
FIG. 4 is a schematic cross-sectional view of a fixing device according to a first modification of the embodiment.

As an example, FIG. 4 shows a leaf spring member 290 according to a first modification of the depicted embodiment of the present invention. The leaf spring member 290 includes a distal end portion 191 and a base portion 192.

In the first modification, the distal end portions 291 are positioned rearward, i.e., upstream of the corresponding base portions 292 in the circular movement direction of the endless belt 110. Incidentally, the base portion 291 is fixed to a mounting part 283 by a screw 299, as in the depicted embodiment.

Further, in the leaf spring member 290 of the first modification, the distal end portion 291 includes a flat portion 291B serving as a contact surface 291B configured to be in contact with the outer peripheral surface 110B of the endless belt 110.

In other words, the distal end portion 291 of the leaf spring member 290 of the first embodiment is provided with the contact surface 291B of a flat shape, unlike the curved contact surface 191A of the depicted embodiment.

In this configuration of the first modification, the contact surface 291B of the leaf spring member 290 is positioned upstream relative to the nip region N in the circular movement direction of the endless belt 110. However, the contact surface 291B may not necessarily positioned upstream of the nip region N in the circular movement direction of the endless belt 110.

Figure 5:
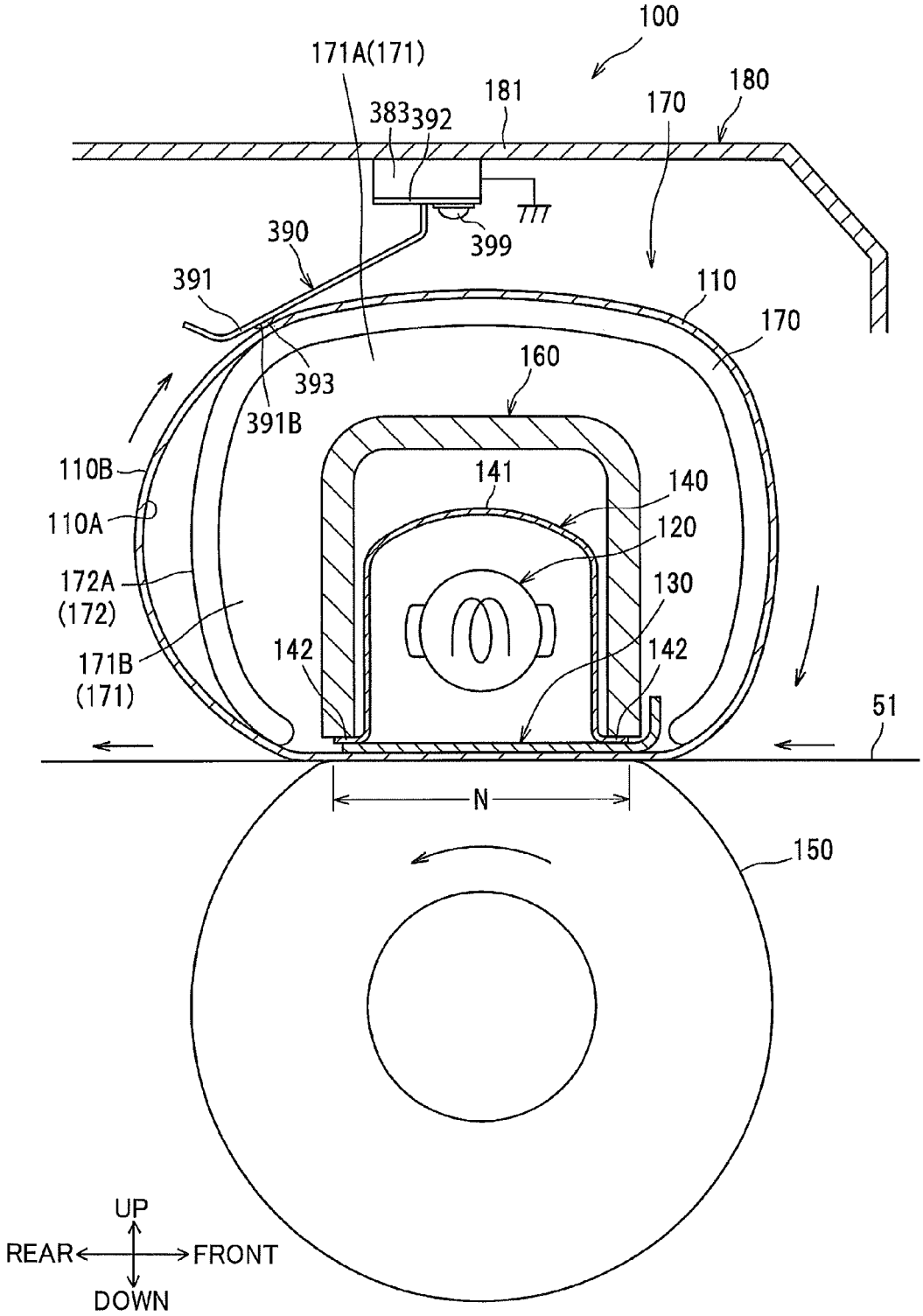
FIG. 5 is a schematic cross-sectional view of a fixing device according to a second modification of the embodiment.

As an illustrative example, FIG. 5 shows a leaf spring member 390 according to a second modification of the embodiment.

The leaf spring member 390 includes a distal end portion 391 and a base portion 392. The base portion 392 is fixed to a mounting part 383 by a screw 399, as in the depicted embodiment.

Unlike the flat contact surface 291B of the first modification, the distal end portion 391 of the second modification includes a flat contact surface 391B that is positioned rearward, i.e., downstream of the nip region N in the circular movement direction of the endless belt 110.

Further, a thermistor 393 is provided as an example of a temperature sensor at the contact surface 391B of each leaf spring member 390 in the second embodiment. Thus the contact surface 391B is indirectly in contact with the outer peripheral surface 110B of the endless belt 110 via the thermistor 393. The thermistor 393 is a contact-type thermistor and is configured to detect a temperature of the endless belt 110. The thermistor 193 is fixed to the corresponding contact surface 191B using an adhesive agent, for example. With this structure, temperatures of the left and right end portions of the outer peripheral surface 110B of the endless belt 110 can be detected with accuracy. Incidentally, the thermistor 393 may be provided for each of the both leaf spring members 390, or may be provided for only one of the leaf spring members 390.

Detection results from the thermistors 193 are configured to be inputted into a control unit (not shown) provided in the main frame 2. The control unit may be configured to determine that the temperature has risen at the end portions of the endless belt 110 if the detection results of the thermistors 193 exceed a prescribed temperature, for example. If this is the case, the control unit may configured to implement control measures such as lowering an output of the halogen lamp 120, or lengthening an interval for conveying the sheets 51. Such control measures are well known in the art, and detailed descriptions therefor are omitted.

Further, although the pair of leaf spring members 190 of the embodiment is made of a metal, the leaf spring members 190 may be made from a resin, for example, an electrically conductive resin.

The leaf spring members 190 of the embodiment are both electrically grounded. However, only one of the leaf spring members 190 may be electrically grounded, or neither of the leaf spring members 190 may be electrically grounded.

Further, the leaf spring members 190 are disposed outside of the image forming region W in the left-right direction in the embodiment. However, the leaf spring members 190 may be disposed inside the image forming region W in the left-right direction.

Further, the leaf spring members 190 are employed as examples of first and second pressing members, but torsion springs may also be available as the first and second pressing members.

Incidentally, there is no particular limitation on the shape of the guide members 170 in the above-described embodiment. The shape of the guide members 170 can be specified arbitrarily. For example, the guide member 170 may be provided with a guide for guiding the outer peripheral surface 110B of the endless belt 110, in addition to the first and second pressing members.

In the above-described embodiment, the pressure roller 150 corresponds to an example of the rotary body, but a belt-shaped member may be also available as the rotary body.

The contact-type thermistors 393 are presented as an example of the temperature sensor in the second modification. However, infrared sensors may also be available as the temperature sensor.

In the second modification shown in FIG. 5, the contact surface 391B of the leaf spring member 390 is provided with the thermistor 393 and is located rearward of the nip region N. However, the contact surface 391B having the thermistor 393 is not necessarily positioned rearward of (downstream of) the nip region N, but may be positioned frontward of the nip region N.

Figure 6:
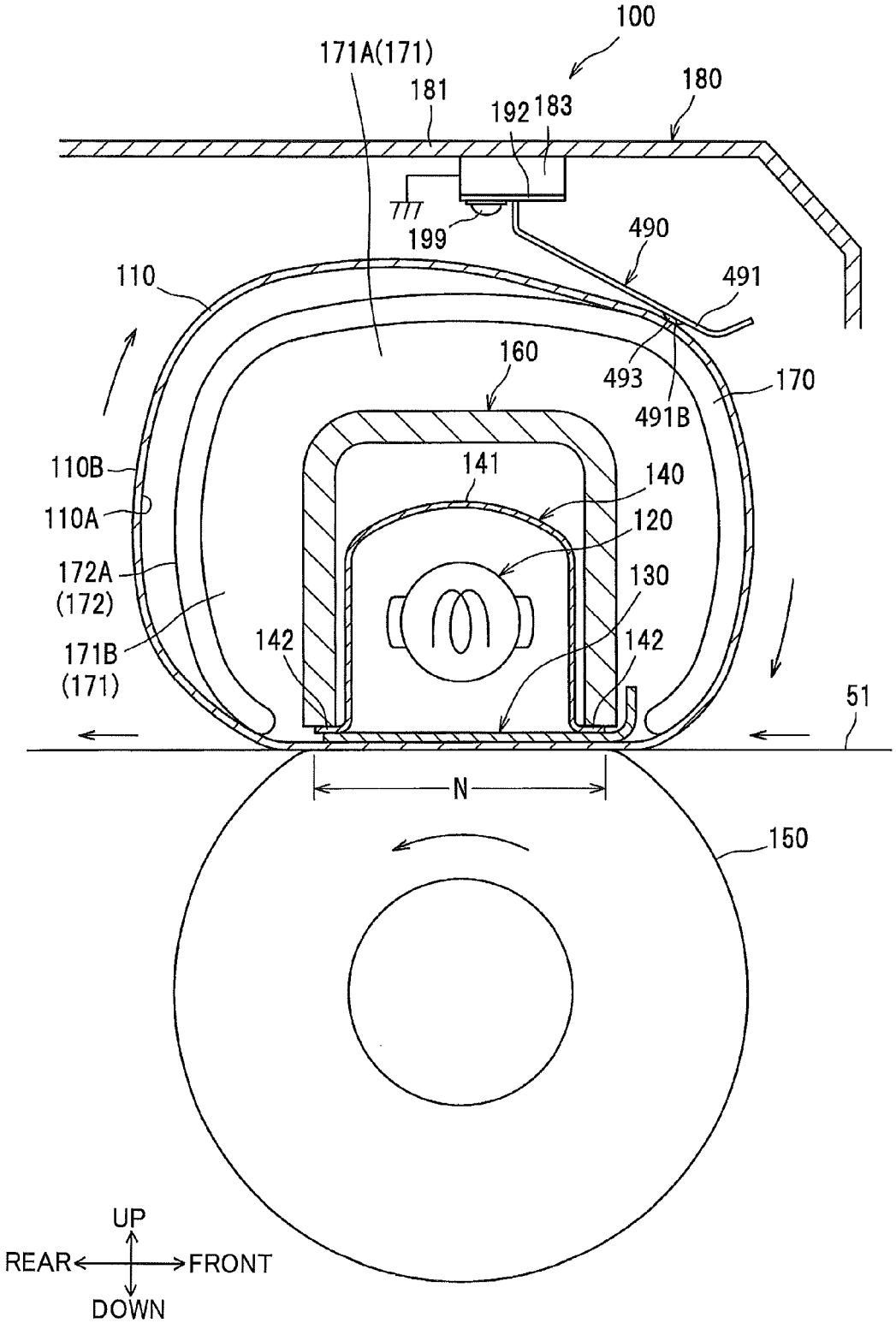
FIG. 6 is a schematic cross-sectional view of a fixing device according to a third modification of the embodiment.

As an illustrative example, FIG. 6 shows a leaf spring member 490 according to a third modification of the embodiment. In the leaf spring member 490, a distal end portion 491 has a flat contact surface 491B provided with a thermistor 493. The contact surface 491B is positioned frontward of the nip region N, i.e., upstream of the nip region N in the circular movement direction of the fusing belt 110.

Further, in the depicted embodiment, the present invention is applied to the color laser printer 1 as an example of an image forming apparatus. However, the present invention may also be applicable to a copying machine, and a multi-function device.

While the invention has been described in detail with reference to the embodiments thereof, it would be apparent to those skilled in the art that various changes and modifications may be made therein without departing from the spirit of the invention.

What is claimed is:

1. A fixing device comprising:

an endless belt configured to circularly move in a moving direction about an axis extending in an axial direction, the endless belt having an inner peripheral surface and an outer peripheral surface, the outer peripheral surface having a first outer end portion and a second outer end portion in the axial direction, the inner peripheral surface having a first inner end portion and a second inner end portion in the axial direction;

a frame;

a first pressing member having a first contact portion configured to be in contact with the first outer end portion, the first pressing member being a leaf spring and configured to press the first outer end portion toward the inner peripheral surface, the first pressing member including a first base portion fixed to the frame and a first distal end portion functioning as the first contact portion, the first distal end portion being positioned at one of upstream and downstream relative to the first base portion in the moving direction of the endless belt; and a second pressing member having a second contact portion configured to be in contact with the second outer end portion, the second pressing member being a leaf spring and configured to press the second outer end portion toward the inner peripheral surface, the second pressing member including a second base portion fixed to the frame and a second distal end portion functioning as the second contact portion, the second distal end portion being positioned at the one of upstream and downstream relative to the second base portion in the moving direction of the endless belt.

2. The fixing device as claimed in claim 1, wherein the first distal end portion is positioned downstream of the first base portion in the moving direction of the endless belt; and wherein the second distal end portion is positioned downstream of the second base portion in the moving direction of the endless belt.

3. The fixing device as claimed in claim 1, wherein the first distal end portion is positioned upstream of the first base portion in the moving direction of the endless belt; and wherein the second distal end portion is positioned upstream of the second base portion in the moving direction of the endless belt.

4. The fixing device as claimed in claim 1, wherein the first contact portion and the second contact portion are positioned to be aligned with each other in the axial direction.

5. The fixing device as claimed in claim 1, wherein the first contact portion has a curved shape protruding toward the first outer end portion of the endless belt; and wherein the second contact portion has a curved shape protruding toward the second outer end portion of the endless belt.

6. The fixing device as claimed in claim 1, further comprising:

a first guide configured to guide the first inner end portion of the endless belt; and a second guide configured to guide the second inner end portion of the endless belt, wherein the first contact portion and the first guide are configured to nip the endless belt therebetween; and wherein the second contact portion and the second guide are configured to nip the endless belt therebetween.

7. The fixing device as claimed in claim 1, further comprising a rotary body configured to form a nip region in cooperation with the endless belt, wherein the endless belt is configured to move in a prescribed direction at the nip region;

wherein the first contact portion is positioned upstream of the nip region in the prescribed direction; and wherein the second contact portion is positioned upstream of the nip region in the prescribed direction.

8. The fixing device as claimed in claim 1, further comprising a rotary body configured to form a nip region in cooperation with the endless belt, wherein the endless belt is configured to move in a prescribed direction at the nip region; and wherein the first contact portion is positioned downstream of the nip region in the prescribed direction; and wherein the second contact portion is positioned downstream of the nip region in the prescribed direction.

9. The fixing device as claimed in claim 1, wherein the endless belt defines an image forming region on the outer peripheral surface in the axial direction;

wherein the first contact portion is positioned outside of the image forming region in the axial direction; and wherein the second contact portion is positioned outside of the image forming region in the axial direction.

10. The fixing device as claimed in claim 1, wherein the first pressing member is made of metal and the second pressing member is made of metal.

11. The fixing device as claimed in claim 1, wherein the first pressing member is made of resin and the second pressing member is made of resin.

12. The fixing device as claimed in claim 1, wherein the first contact portion further comprises a temperature sensor configured to detect a temperature of the endless belt.

13. The fixing device as claimed in claim 1, wherein the first pressing member is electrically grounded.

14. A fixing device comprising:

an endless belt configured to circularly move about an axis extending in an axial direction, the endless belt having an inner peripheral surface and an outer peripheral surface, the outer peripheral surface having a first outer end portion and a second outer end portion in the axial direction, the inner peripheral surface having a first inner end portion and a second inner end portion in the axial direction;

a rotary body configured to form a nip region in cooperation with the endless belt, the endless belt being configured to move in a prescribed direction at the nip region;

a first pressing member having a first contact portion configured to be in contact with the first outer end portion, the first pressing member being configured to press the first outer end portion toward the inner peripheral surface, the first contact portion being positioned at one of upstream and downstream relative to the nip region in the prescribed direction; and a second pressing member having a second contact portion configured to be in contact with the second outer end portion, the second pressing member being configured to press the second outer end portion toward the inner peripheral surface, the second contact portion being positioned at the one of upstream and downstream relative to the nip region in the prescribed direction.

15. The fixing device as claimed in claim 14, wherein the first contact portion is positioned upstream of the nip region in the prescribed direction; and wherein the second contact portion is positioned upstream of the nip region in the prescribed direction.

16. The fixing device as claimed in claim 14, wherein the first contact portion is positioned downstream of the nip region in the prescribed direction; and wherein the second contact portion is positioned downstream of the nip region in the prescribed direction.

17. The fixing device as claimed in claim 14, wherein the first pressing member is made of metal and the second pressing member is made of metal.

18. The fixing device as claimed in claim 14, wherein the first contact portion has a curved shape protruding toward the first outer end portion of the endless belt; and wherein the second contact portion has a curved shape protruding toward the second outer end portion of the endless belt.

19. The fixing device as claimed in claim 14, further comprising:

A first guide configured to guide the first inner end portion of the endless belt; and a second guide configured to guide the second inner end portion of the endless belt, wherein the first contact portion and the first guide are configured to nip the endless belt therebetween; and wherein the second contact portion and the second guide are configured to nip the endless belt therebetween.

* * * * *